US007192205B2

(12) United States Patent
Kang et al.

(10) Patent No.: US 7,192,205 B2
(45) Date of Patent: Mar. 20, 2007

(54) METHOD FOR REDUCING PRINTING POSITION ERROR AND IMAGE FORMING APPARATUS USING THE SAME

(75) Inventors: Kyung-pyo Kang, Suwon-si (KR); Hyoung-il Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/375,049

(22) Filed: Mar. 15, 2006

(65) Prior Publication Data

US 2006/0285907 A1 Dec. 21, 2006

(30) Foreign Application Priority Data

Jun. 21, 2005 (KR) ..... 10-2005-0053597

(51) Int. Cl.
*B41J 11/44* (2006.01)
*B65H 7/02* (2006.01)
*G03G 15/00* (2006.01)

(52) U.S. Cl. ..... 400/76; 271/228; 271/902; 399/384

(58) Field of Classification Search ..... 271/902, 271/258.01, 265.01

See application file for complete search history.

(56) References Cited

U.S. PATENT DOCUMENTS

| | | | | |
|---|---|---|---|---|
| 6,714,758 | B2 * | 3/2004 | Miyamoto et al. | 399/384 |
| 7,079,803 | B2 * | 7/2006 | Kikuchi et al. | 399/396 |
| 2002/0081132 | A1 * | 6/2002 | Miyamoto et al. | 399/384 |
| 2003/0039496 | A1 * | 2/2003 | Miyamoto et al. | 399/384 |
| 2003/0133731 | A1 * | 7/2003 | Nakazawa et al. | 399/384 |
| 2003/0165349 | A1 * | 9/2003 | Nakazawa | 399/384 |

FOREIGN PATENT DOCUMENTS

| | | |
|---|---|---|
| JP | 05-197313 | 8/1993 |
| JP | 08-224912 | 9/1996 |
| JP | 2003-291437 | 10/2003 |
| KR | 1990-0009300 | 7/1990 |
| KR | 01-25501 | 5/1995 |

* cited by examiner

*Primary Examiner*—Judy Nguyen
*Assistant Examiner*—Wasseem H. Hamdan
(74) *Attorney, Agent, or Firm*—Roylance, Abrams, Berdo & Goodman, LLP

(57) ABSTRACT

An apparatus and method are provided for reducing a printing position error, in which the method includes the steps of (a) driving an encoder wheel as many times as a predetermined number of forward counts at a predetermined initial acceleration, thereby making the edge of a printing paper become separated from a sensing unit and conveyed in a forward direction, (b) driving the encoder wheel at the predetermined initial acceleration and conveying the printing paper in a backward direction, (c) calculating a difference value between the number of backward counts of the encoder wheel from a start time of the backward driving to a point when the sensing unit detects the edge of the printing paper and the number of forward counts, and (d) repeating the steps (a) through (c) for a designated number of times while varying the predetermined initial acceleration, and setting an initial acceleration corresponding to a smallest value among the difference values as the initial acceleration for driving the encoder wheel. Therefore, in the case of separately printing data on one printing paper several times, the resolution of a printed image can be improved by reducing the printing position error.

20 Claims, 3 Drawing Sheets

METHOD FOR REDUCING PRINTING POSITION ERROR AND IMAGE FORMING APPARATUS USING THE SAME

CROSS-REFERENCE TO RELATED APPLICATIONS

This application claims the benefit under 35 U.S.C. § 119(a) of Korean Patent Application No. 10-2005-0053597, filed in the Korean Intellectual Property Office on Jun. 21, 2005, the entire disclosure of which is hereby incorporated by reference.

BACKGROUND OF THE INVENTION

1. Field of the Invention

The present invention relates in general to a method for reducing a printing position error. More specifically, the present invention relates to a method for reducing a printing position error by setting an optimal initial acceleration for a motor used in feeding printing papers.

2. Description of the Related Art

In a thermal imaging printing system, which performs the printing operation on both sides (or surfaces) of a printing paper by applying heat using a thermal printhead (TPH), an encoder wheel for feeding the printing paper repeatedly rotates in the forward and backward directions.

In order to obtain high quality prints, it is important to accurately predict a feeding distance of the printing paper along the forward and backward rotation of the encoder wheel. That is, in heating both sides of the paper by the TPH, an accurate, clear output image can be obtained when printing start positions on both sides coincide with each other.

FIG. 1 is a diagram of a conventional TPH printing system.

As shown in FIG. 1, the TPH printing system according to one embodiment of the related art comprises a sensing unit 10, an encoder wheel 20, a feeding roller 30, a pressing roller 40, a printing paper 50, and a TPH 60.

The sensing unit 10 transmits a printing paper detection signal to a driving control unit (not shown) as the printing paper 50 is fed, and the encoder wheel 20 rotates in the forward or backward direction under the control of the driving control unit.

The feeding roller 30 is rotatably mounted on a shaft of a drive motor (not shown) that is controlled by the driving control unit. Therefore, the feeding roller 30 rotates in the forward or backward direction along the rotation of the drive motor, and feeds the printing paper 50 in the forward or backward direction.

When the printing paper 50 is fed by the feeding roller 30 and the pressing roller 40, the TPH 60 applies heat to both sides of the printing paper 50 in order to print a target image.

The printing operation in the TPH printing system of the related art always accompanies the paper feeding in the forward and backward directions. To do so, the drive motor connected to the driving control unit rotates the feeding roller 30 and the encoder wheel 20 coupled thereto, and the printing paper 50 is transported by the rotation of the feeding roller 30 and the encoder wheel 20.

However, at the start of the rotation, the printing paper 50 resists the paper feed force in the horizontal direction generated by an initial acceleration of the drive motor, and therefore, the printing paper 50 moves slightly laterally in the rotation direction of a driving shaft commonly coupled to the feeding roller 30 and the encoder wheel 20.

However, since this slight movement of the printing paper 50 is not reflected in the rotation of the feeding roller 30 and the encoder wheel 20, the feeding distance of the printing paper 50 is not included in the number of counts of the encoder wheel 20.

Therefore, there is a small difference between the actual distance that the printing paper 50 is conveyed and the measured feeding distance of the printing paper 50 determined by the number of counts of the encoder wheel 20. This difference exists in both forward rotation and backward rotation of the encoder wheel 20, and is influenced by the initial acceleration set for the drive motor.

Further, even though the actual print quality generated by the TPH printing system becomes deteriorated, the same initial acceleration is applied to paper feeding, without considering the slight horizontal shift of the driving shaft itself. As a consequence, the deterioration in the print quality of an image can not be prevented.

Accordingly, a need exists for a system and method for maintaining or improving print quality by eliminating undesired paper movement at the start of feeding roller rotation.

SUMMARY OF THE INVENTION

It is, therefore, an object of embodiments of the present invention to substantially solve the above and other problems, and to provide a method for reducing a printing position error by setting an optimal initial acceleration at the time of driving a motor for paper feeding.

To achieve the above and other objects and advantages, a method is provided for reducing a printing position error, comprising the steps of (a) driving an encoder wheel as many times as a predetermined number of forward counts at a predetermined initial acceleration, thereby making the edge of a printing paper become separated from a sensing unit and conveyed in a forward direction, (b) driving the encoder wheel at the predetermined initial acceleration and conveying the printing paper in a backward direction, (c) calculating a difference value between the number of backward counts of the encoder wheel from a start time of the backward driving to a point when the sensing unit detects the edge of the printing paper and the number of forward counts, and (d) repeating the steps (a) through (c) for a designated number of times while varying the predetermined initial acceleration, and setting an initial acceleration corresponding to a smallest value among the difference values, as the initial acceleration for driving the encoder wheel.

Preferably, in an exemplary embodiment of the present invention, the control of the encoder wheel is executed by a driving control unit.

In an exemplary embodiment of the present invention, the printing paper is fed by a feeding roller coupled to the encoder wheel.

In an exemplary embodiment of the present invention, a shaft of the encoder wheel can slightly shift in the horizontal direction as a result of the backward driving.

The method further comprises the step of driving the encoder wheel at the initial acceleration set in the step (d).

In an exemplary embodiment of the present invention, the printing paper is printed by using a thermal printhead (TPH).

In an exemplary embodiment of the present invention, the predetermined number of forward counts can be set arbitrarily.

In an exemplary embodiment of the present invention, the TPH is used for heating both sides of the printing paper to print an image thereon.

In an exemplary embodiment of the present invention, the encoder wheel is coupled to the drive motor that is controlled by the driving control unit.

In an exemplary embodiment of the present invention, the encoder wheel is a strip encoder making a straight line motion.

Another aspect of embodiments of the present invention is to provide an image forming apparatus, comprising an encoder wheel, which drives as many times as a predetermined number of forward counts at a predetermined initial acceleration, thereby making the edge of a printing paper become separated from a sensing unit and conveyed in a forward direction, and which drives in a backward direction to feed the printing paper in the backward direction, and a driving control unit for calculating a difference value between the number of backward counts of the encoder wheel from a start time of the backward driving to a point when the sensing unit detects the edge of the printing paper and the number of forward counts, wherein the driving control unit obtains a designated number of the difference values by varying the predetermined initial acceleration, and thereafter setting an initial acceleration corresponding to a smallest value among the difference values as the initial acceleration for driving the encoder wheel.

Preferably, in an exemplary embodiment of the present invention, the driving control unit controls the driving of the encoder wheel.

In an exemplary embodiment of the present invention, the printing paper is fed by a feeding roller coupled to the encoder wheel.

In an exemplary embodiment of the present invention, a shaft of the encoder wheel can slightly shift in the horizontal direction as a result of the backward driving.

In an exemplary embodiment of the present invention, the feed roller coupled to the encoder wheel is driven at the initial acceleration set by the driving control unit.

In an exemplary embodiment of the present invention, the printing paper is printed by using a thermal printhead (TPH).

In an exemplary embodiment of the present invention, the predetermined number of forward counts can be set arbitrarily.

In an exemplary embodiment of the present invention, the TPH is used for heating both sides of the printing paper to print an image thereon.

In an exemplary embodiment of the present invention, the encoder wheel is coupled to the drive motor that is controlled by the driving control unit.

In an exemplary embodiment of the present invention, the encoder wheel is a strip encoder making a straight line motion.

BRIEF DESCRIPTION OF THE DRAWINGS

The above aspects and features of embodiments of the present invention will become more apparent by describing certain embodiments of the present invention with reference to the accompanying drawings, in which.

Throughout the drawings, like reference numerals will be understood to refer to like parts, components and structures

DETAILED DESCRIPTION OF EXEMPLARY EMBODIMENTS

Exemplary embodiments of the present invention will be described herein below with reference to the accompanying drawings.

Figure 1:
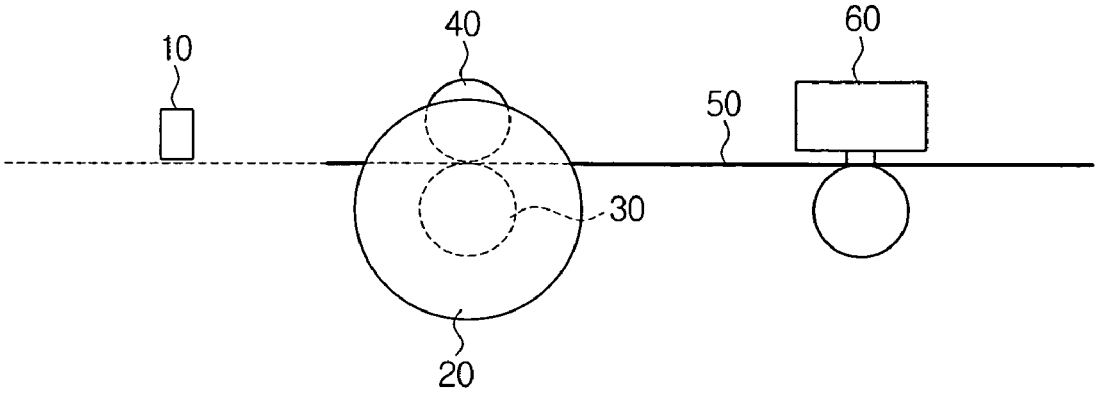
FIG. 1 (PRIOR ART)
FIG. 1 is a diagram of a related art TPH printing system.
Figure 2:
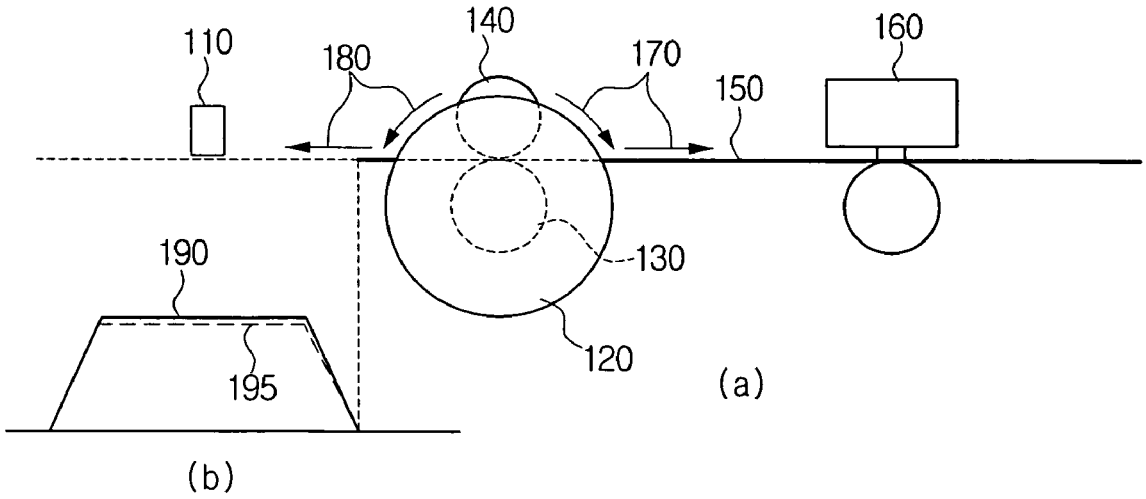
FIG. 2 is a diagram of a TPH printing system according to an embodiment of the present invention.

FIG. 2 is a diagram of a TPH printing system according to one embodiment of the present invention.

As shown in (a) of FIG. 2, the TPH printing system comprises a sensing unit 110, an encoder wheel 120, a feeding roller 130, a pressing roller 140, a printing paper 150, and a TPH 160.

Similar to the above-described TPH printing system of the related art, the sensing unit 110 transmits a printing paper detection signal as the printing paper 150 is fed to a driving control unit (not shown), and the encoder wheel 120 rotates in the forward or backward direction under the control of the driving control unit.

The feeding roller 130 is rotatably mounted on a shaft of a drive motor (not shown) that is controlled by the driving control unit. Therefore, the feeding roller 130 rotates in the forward or backward direction along the rotation of the drive motor, and feeds the printing paper 150 in the forward or backward direction.

The pressing roller 140 stands opposite to the feeding roller 130 having the printing paper 150 therebetween. Thus, the pressing roller 140 and the feeding roller 130 work together to transport the printing paper 150.

When the printing paper 150 is fed by the feeding roller 130 and the pressing roller 140, the TPH 160 applies heat to both sides of the printing paper 150 in order to print a target image.

Referring to FIG. 2, a method for reducing a printing position error according to an embodiment of the present invention will now be described. In the initial stage of driving the feeding roller 130, the shaft of the feeding roller 130 slightly shifts in the horizontal direction, thereby causing an inherent printing position error to an image forming apparatus as in the related art. Such printing position error is influenced by the initial acceleration set for driving the feeding roller 130.

Therefore, embodiments of the present invention comprise a system and method to calculate the initial acceleration where the printing position error is minimized, and determine an optimal initial acceleration for driving the feeding roller 130.

In order to calculate the initial acceleration where the printing position error is minimized, the driving control unit drives the drive motor in a forward direction 170 at a first predetermined acceleration while an edge of the printing paper 150 has already been detected by the sensing unit 110.

Once the drive motor starts driving, the edge of the printing paper 150 is separated from the sensing unit 110, and the encoder wheel 120 starts rotating in the forward direction 170 as many times as a predetermined number of counts. Here, the number of counts in the forward direction may be determined and set in the product manufacturing stage in consideration of the surrounding environment where the present invention is implemented, or may be determined and set arbitrarily by a user.

As the encoder wheel 120 is driven, the printing paper 150 is moved in the forward direction 170. After driving as many times as the number of the predetermined forward counts, the drive motor stops driving under the control of the driving control unit, and therefore the printing paper 150 stops moving forward.

Next, the driving control unit drives the drive motor in a backward direction 180 at the first predetermined acceleration.

Then, the encoder wheel 120 and the feeding roller 130 coupled to the drive motor start driving in the backward direction 180 and the printing paper 150 is conveyed in the backward direction 180 accordingly. As a result, the end of the printing paper 150 is again detected by the sensing unit 110, and the driving control unit stops the backward driving of the motor.

The driving control unit then computes the number of backward counts of the encoder wheel 120 from the start time of the backward driving to the point when the sensing unit 110 detects the edge of the printing paper 150.

Here, a difference value between the number of forward counts and the number of backward counts is stored in a memory inside the driving control unit. The difference value is generated due to the horizontal shift of the shaft commonly coupled to the encoder wheel 120 and the feeding roller 130 under the influence of the initial driving acceleration of the driving control unit.

In the TPH printing system, the smaller the difference value between the number of forward counts and the number of backward counts, the better the printing operation. Also, the difference value varies according to the initial acceleration of the drive motor.

Therefore, to obtain an optimal initial acceleration for the drive motor, and for the encoder wheel 120 and feeding roller 130 that are coupled the drive motor, a number of difference values are obtained in response to different initial accelerations.

That is, while the edge of the printing paper 150 is being detected by the sensing unit 110, the driving control unit again drives the drive motor in the forward direction 170 at a second predetermined initial acceleration.

As soon as the drive motor starts driving, the edge of the printing paper 150 is separated from the sensing unit 110, and the encoder wheel 120 starts driving in the forward direction 170 as many times as a predetermined forward counts.

Then, the printing paper 150 is conveyed in the forward direction 170. Following the forward driving by the predetermined number of counts, the drive motor stops driving under the control of the driving control unit, and the printing paper 150 is conveyed no further.

Next, the driving control unit again drives the drive motor in the backward direction 180 at the second predetermined initial acceleration. Thus, the encoder wheel 120 and the feed roller 130 that are coupled to the drive motor start running in the backward direction 180, and the printing paper 150 is conveyed in the backward direction 180. When the sensing unit 110 detects the edge of the printing paper 150 again, the driving control unit stops driving the drive motor in the backward direction 180.

The driving control unit then counts the number of backward counts of the encoder wheel 120 from the start time of the backward driving to the point when the sensing unit 110 detects the edge of the printing paper 150.

Similar to before, the difference value between the number of forward counts and the number of backward counts is stored in the memory. This can be repeated to provide a number of difference values obtained by driving the drive motor at a third, fourth, . . . and an N-th initial acceleration, and the difference values and initial acceleration values associated with each can then be stored in the memory of the driving control unit.

The first through N-th initial accelerations are set to have different values from one another, and each of the initial accelerations and the number of tests are determined in consideration of the surrounding environment.

The driving control unit selects the smallest value among the difference values stored in the memory, and sets the corresponding initial acceleration thereof as the initial acceleration for driving the drive motor, the encoder wheel 120 and the feed roller 130. Therefore, for a subsequent printing operation, the printing paper is conveyed in the forward direction 170 and the backward direction 180 by the drive motor which starts driving at the initial acceleration set by the driving control unit.

Figure 3:
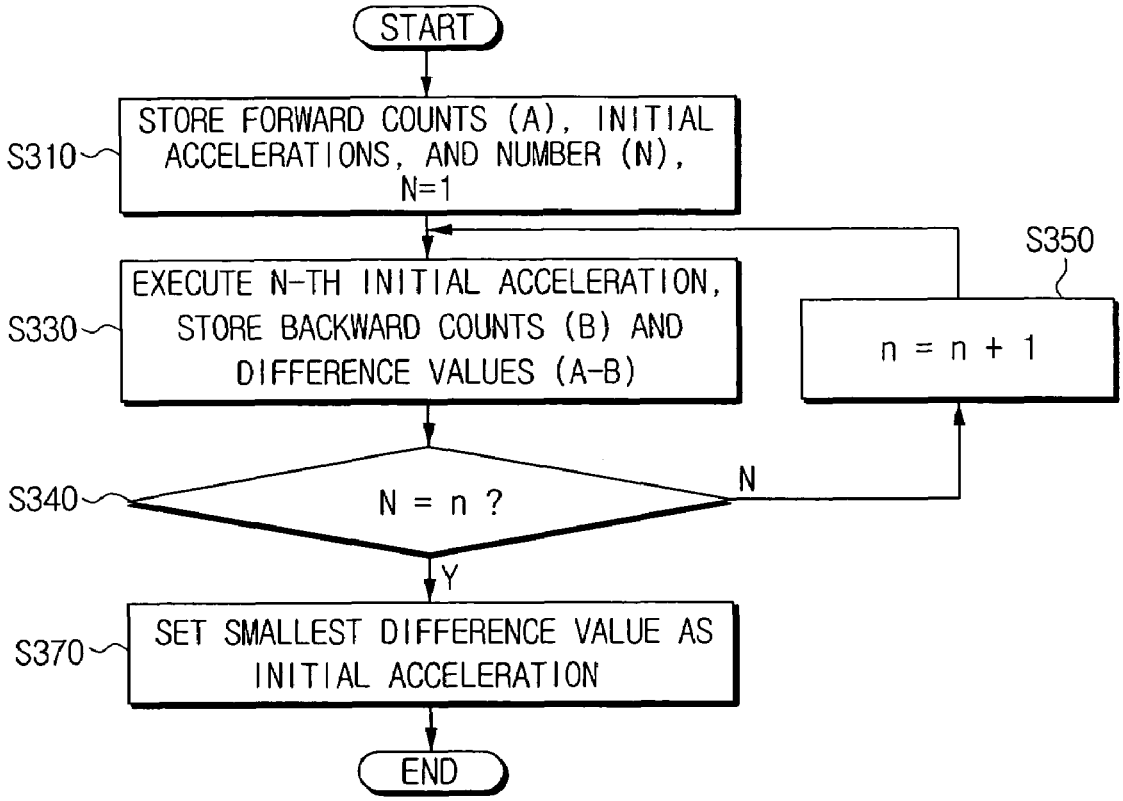
FIG. 3 is a flow chart illustrating a method for reducing a printing position error according to an embodiment of the present invention.

FIG. 3 is a flow chart describing a method for reducing a printing position error according to an embodiment of the present invention. For illustrating the method of FIG. 3, the following description will refer to both FIGS. 2 and 3. At a first step, the driving control unit stores a predetermined number of forward counts 'A', the first through N-th initial accelerations, and the number of initial accelerations 'N' at step (S310).

Then, the driving control unit calculates a difference value (A−B) between the number of forward counts A and the number of backward counts 'B', and stores the result at step (S330).

In more detail, in step (S330), when the edge of the printing paper 150 is detected by the sensing unit 110, the driving control unit drives the drive motor in the forward direction 170 at the first initial acceleration.

Once the drive motor starts running, the edge of the printing paper 150 is separated from the sensing unit 110, and the encoder wheel 120 starts driving in the forward direction 170 as many times as the number of forward counts A.

As a result, the printing paper 150 is conveyed in the forward direction 170. Following the forward driving by the number of forward counts A, the drive motor stops driving under the control of the driving control unit, and the printing paper 150 is conveyed no further.

Then, the driving control unit drives the drive motor in the backward direction 180 at the first initial acceleration. Thus, the encoder wheel 120 and the feed roller 130 that are coupled to the drive motor start running in the backward direction 180, and the printing paper 150 is conveyed in the backward direction 180. When the edge of the printing paper 150 is detected by the sensing unit 110, the driving control unit stops driving the drive motor in the backward direction 180.

Next, the driving control unit computes the number of backward counts B of the encoder wheel 120 from the start time of the backward driving to the point when the sensing unit 110 detects the edge of the printing paper 150, and stores the result in its memory.

The driving control unit then calculates the difference value (A−B) between the number of forward counts A and the number of backward counts B, and stores the result in its memory.

Next, the driving control unit checks whether N=n at step (S340), to determine whether the difference values are calculated and stored for every initial acceleration stored in the memory. If N is not equal to n at step (S340), the driving control unit recognizes that difference values for some initial accelerations are not calculated and stored in the memory, so it sets 'n+1' as 'n' at step (S350) and repeats the step (S330) for another initial acceleration value.

On completion of calculating and storing the difference values for all initial accelerations stored in the memory, the driving control unit selects the smallest value among the difference values for all initial accelerations and sets the smallest value to the initial acceleration for driving the drive motor at step (S370).

For a subsequent printing operation, the printing paper is conveyed in the forward direction 170 and the backward direction 180 by the drive motor which starts driving at the initial acceleration set in step (S370). Referring to (b) of FIG. 2, in this manner, the speed change 190 in the drive motor is almost identical with the paper feeding speed change 195. Plot (b) of FIG. 2 illustrates the speed change 190 in the drive motor and the speed change 195 in the paper feed.

Figure 4:
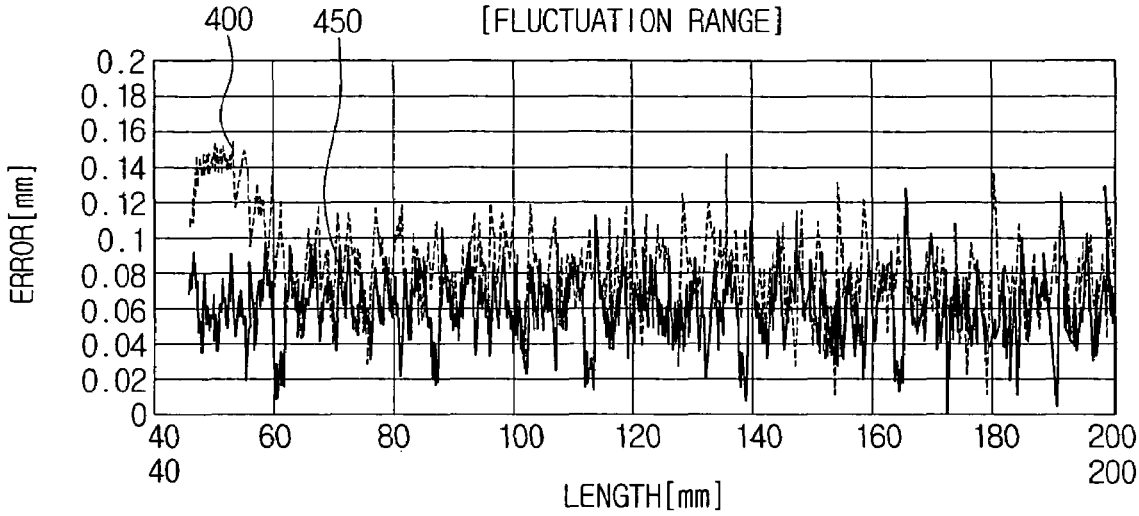
FIG. 4 is a graph illustrating a test result of a printing position error reduction method according to an embodiment of the present invention.

FIG. 4 is a graph illustrating exemplary test results of the method for reducing a printing position error according to an embodiment of the present invention. Particularly, FIG. 4 shows the error rates in two different cases, one where the initial acceleration is large 400, and the other where the initial acceleration is small 450. Here, the error corresponds to the difference between the distance that the printing paper is actually conveyed and the feeding distance of the printing paper the driving control unit determines based on the number of counts of the encoder wheel.

In general, the error is smaller when the initial acceleration is small 450. However, this is not true for all length intervals though. Therefore, one cannot conclude that a small initial acceleration always reduces the error because an optimal initial acceleration should be determined according to the surrounding environment where embodiments of the present invention are implemented, and according to the procedure explained in FIG. 3.

The printing position error reducing method of embodiments of the present invention can be implemented in a general image forming apparatus equipped with the paper feed roller and the sensing unit for determining the feeding distance of the paper.

According to embodiments of the present invention, in the case of separately printing data on one printing paper several times, the resolution of a printed image can be improved by reducing the printing position error. Moreover, by setting an optimal initial acceleration for driving the drive motor, components involved in driving the drive motor can be free of unnecessary shocks and the performance of each component can be continuously maintained.

Although exemplary embodiments of the present invention have been described, it will be understood by those skilled in the art that the present invention should not be limited to the described exemplary embodiments, but various changes and modifications can be made within the spirit and scope of the present invention as defined by the appended claims.

What is claimed is:

1. A method for reducing a printing position error, the method comprising the steps of:

(a) driving an encoder wheel as many times as a predetermined number of forward counts at a predetermined initial acceleration, thereby making the edge of a printing paper become separated from a sensing unit and conveyed in a forward direction;

(b) driving the encoder wheel at the predetermined initial acceleration and conveying the printing paper in a backward direction, thereby making the edge of the printing paper become in contact with the sensing unit and generating a number of backward counts;

(c) calculating a difference value between the number of backward counts of the encoder wheel from a start time of the backward driving to a point when the sensing unit detects the edge of the printing paper and the number of forward counts; and (d) repeating the steps (a) through (c) for a designated number of times while varying the predetermined initial acceleration, and setting an initial acceleration corresponding to a smallest value among the difference values as the initial acceleration for driving the encoder wheel.

2. The method of claim 1, wherein the control of the encoder wheel is executed by a driving control unit.

3. The method of claim 1, wherein the printing paper is fed by a feeding roller coupled to the encoder wheel.

4. The method of claim 1, wherein a shaft of the encoder wheel slightly shifts in the horizontal direction as a result of the backward driving.

5. The method of claim 1, further comprising the step of:

driving the encoder wheel at the initial acceleration set in the step (d).

6. The method of claim 1, wherein the printing paper is printed by using a thermal printhead (TPH).

7. The method of claim 1, wherein the predetermined number of forward counts can be arbitrarily set.

8. The method of claim 1, wherein the TPH is used for heating both sides of the printing paper to print an image thereon.

9. The method of claim 1, wherein the encoder wheel is coupled to a drive motor that is controlled by a driving control unit.

10. The method of claim 1, wherein the encoder wheel comprises at least one of a rotary and linear encoder.

11. An image forming apparatus, comprising:

an encoder wheel, which can be driven as many times as a predetermined number of forward counts at a predetermined initial acceleration, thereby making the edge of a printing paper become separated from a sensing unit and conveyed in a forward direction, and which can be driven in a backward direction to feed the printing paper in the backward direction to become into contact with the sensing unit and generate a number of backward counts; and a driving control unit for calculating a difference value between the number of backward counts of the encoder wheel from a start time of the backward driving to a point when the sensing unit detects the edge of the printing paper and the number of forward counts, wherein, the driving control unit obtains a designated number of the difference values by varying the predetermined initial acceleration, and setting an initial acceleration corresponding to a smallest value among the difference values as the initial acceleration for driving the encoder wheel.

12. The apparatus of claim 11, wherein the driving control unit is configured to control the driving of the encoder wheel.

13. The apparatus of claim 11, further comprising a feeding roller, wherein the printing paper is fed by the feeding roller coupled to the encoder wheel.

14. The apparatus of claim 11, further comprising a shaft of the encoder wheel, wherein the shaft of the encoder wheel can slightly shift in the horizontal direction as a result of the backward driving.

15. The apparatus of claim 13, wherein the feed roller coupled to the encoder wheel is driven at the initial acceleration set by the driving control unit.

16. The apparatus of claim 11, further comprising a thermal print head (TPH), wherein the printing paper is printed by the TPH.

17. The apparatus of claim 11, wherein the predetermined number of forward counts can be arbitrarily set.

18. The apparatus of claim 16, wherein the TPH is configured to heat both sides of the printing paper to print an image thereon.

19. The apparatus of claim 11, further comprising a drive motor, wherein the encoder wheel is coupled to the drive motor that is controlled by the driving control unit.

20. The apparatus of claim 11, wherein the encoder wheel comprises at least one of a rotary and a linear encoder.

* * * * *